US008508426B2

(12) United States Patent
Honda et al.

(10) Patent No.: US 8,508,426 B2
(45) Date of Patent: Aug. 13, 2013

(54) VARIABLE DIRECTIONAL ANTENNA

(75) Inventors: Atsushi Honda, Kawasaki (JP); Ichirou Ida, Kawasaki (JP); Yasuyuki Oishi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 270 days.

(21) Appl. No.: 12/698,703

(22) Filed: Feb. 2, 2010

(65) Prior Publication Data

US 2010/0182214 A1 Jul. 22, 2010

Related U.S. Application Data

(63) Continuation of application No. PCT/JP2007/000860, filed on Aug. 9, 2007.

(51) Int. Cl.

| | |
|---|---|
| ***H01Q 19/10*** | (2006.01) |
| ***H01Q 1/38*** | (2006.01) |
| ***H01Q 19/00*** | (2006.01) |

(52) U.S. Cl.

USPC ..... 343/834; 343/700 MS; 343/833

(58) Field of Classification Search

USPC ..... 343/700 MS, 833, 834

See application file for complete search history.

(56) References Cited

U.S. PATENT DOCUMENTS

| | | | | |
|---|---|---|---|---|
| H26 | H * | 2/1986 | Dinger | 342/372 |
| 5,576,718 | A * | 11/1996 | Buralli et al. | 343/700 MS |
| 6,320,542 | B1 * | 11/2001 | Yamamoto et al. | 343/700 MS |
| 7,242,366 | B2 * | 7/2007 | Shibata | 343/893 |
| 7,773,035 | B2 * | 8/2010 | Murata et al. | 343/700 MS |
| 2008/0036662 | A1 | 2/2008 | Iwata et al. | |
| 2008/0088510 | A1 | 4/2008 | Murata et al. | |

FOREIGN PATENT DOCUMENTS

| | | |
|---|---|---|
| JP | 07058539 | 3/1995 |
| JP | 3439723 | 6/2003 |
| JP | 200660772 | 3/2006 |
| JP | 200737162 | 2/2007 |
| WO | 9112637 | 8/1991 |

OTHER PUBLICATIONS

"Shaped-Beam Microstrip Arrays Antennas", the Institute of Electronics, Information and Communication Engineers (IEICE), p. 250; 2002.

International Search Report dated Nov. 20, 2007, in corresponding International Application No. PCT/JP2007/000860.

(Continued)

*Primary Examiner* — Robert Karacsony
*Assistant Examiner* — Hasan Islam
(74) *Attorney, Agent, or Firm* — Smith, Gambrell & Russell, LLP

(57) ABSTRACT

A variable directional antenna by means of a microstrip antenna and reactance change. The variable directional antenna has a structure to reduce sidelobes occurring when an element interval is reduced, and is structured in a three-element plane, having a feeding element and non-feeding elements provided at both sides of the feeding element. Each of the non-feeding elements provided at both sides of the feeding element has two split non-feeding elements two-divided into sizes of 1:2 in the lateral direction. The split non-feeding element divided into the size 1 is provided closer to the feeding element, and a reactance variable part is connected with the split non-feeding element divided into the size of 2. Alternatively, each of the non-feeding elements provided at both sides of the feeding element has two split non-feeding elements two-divided into sizes of 2:1 in the lateral direction. The split non-feeding element divided into the size 2 is provided closer to the feeding element, and the reactance variable part is connected either with the split non-feeding element divided into the size of 2 or the split non-feeding element divided into the size 1.

8 Claims, 11 Drawing Sheets

(56) References Cited

OTHER PUBLICATIONS

Dinger et al: "A planar version of a 4.0 GHz ractively steered adaptive array" IEEE Transactions on Antennas and Propagation,, vol. 34, No. 3, Mar. 1, 1986 pp. 427-431, XP001383769.

RJ Dinger: "Reactively steered adaptive array using microstrip patch elements at 4GHz" IEEE Transactions on Antennas and Propagation, vol. AP-32, No. 8, Aug. 1, 1984, pp. 848-856, XP002602262.

Tanaka H et al: "Capacity analysis by planar ESPAR Antenna in MIMO Transmission" TENCON 2006. 2006 IEEE Region 10 Conference, IEEE, PI, Nov. 14, 2006, pp. 1-4, XP031333573 ISBN: 978-1-4244-0548-0.

Extended European Search Reported for application No. 07790348.2 dated Oct. 6, 2010.

* cited by examiner

F:Feeding-Point
VR:Variable Reactance-Point
F-MSA:Feeding MSA P-MSA:Parasitic MSA
$S_{21}$, $S_{31}$:Mutual Coupling

DIRECTIVITY OF COMPARISON EXAMPLE

VARIABLE DIRECTIONAL ANTENNA

CROSS-REFERENCE TO RELATED APPLICATIONS

This application is a continuation of International Application No. PCT/JP2007/860, filed on Aug. 9, 2007, now pending, herein incorporated by reference.

FIELD

The present invention relates to a variable directional antenna which is based on the reactance change and uses a micro strip antenna.

BACKGROUND

As an antenna for a wireless terminal, a variable directional antenna, that is an array antenna and yet has antenna directivity that can be changed using one feed element and a parasitic element having a variable capacitance element, has been proposed.

An example thereof is the ESPAR (Electrical Steerable Parasitic Array Radiator) antenna, which can change the directivity of the antenna by changing the reactance value of the parasitic element. This type of antenna has an advantage in terms of cost and power consumption, since a number of receivers can be few, compared with a digital processing type array antenna, which has a receiver for each antenna element.

A conventional ESPAR antenna, however, uses a seven-element mono-pole antenna, as depicted in Patent Document 1.

FIG. 1 is a diagram depicting the configuration depicted in Patent Document 1. A radiative element 2 is disposed at the center of a finite reflector 1 that has a skirt portion 11. A plurality of parasitic elements 3 are disposed around the radiative element 2.

It is not easy to apply this configuration directly to a terminal. In order to make this configuration flat, an example of the ESPAR antenna constituted by a three-element dipole antenna was proposed. A flat type beam shaping antenna using a micro strip antenna was also proposed because of ease of manufacture.

FIG. 2 is a diagram depicting a configuration of a flat type beam shaping antenna using this micro strip antenna (Non-patent Document 1).

In the case of the micro strip antenna depicted in Non-patent Document 1, the coupling between antennas becomes weaker when an array antenna configuration is used, so it is difficult to change the directivity of the antenna unless the degree of coupling is secured by decreasing the space between the elements.

If the space between the antenna elements is decreased, however, the degree of coupling is maintained, but the aperture plane of the array decreases and the side lobe become bigger. If the side lobe becomes bigger in the array antenna, interference suppression capability drops and interference increases.

Patent Document 1: Japanese Patent No. 349723

Non-patent Document 1: 2002 General Conference of IEICE: "Shaped beam micro strip array antenna"

SUMMARY

With the foregoing in view, it is an object of the present invention to provide a variable directional antenna, based on the reactance change and using a micro strip antenna, that has a configuration to decrease the side lobe that generates when the element space is decreased.

A variable directional antenna of the first aspect according to the present invention realizing the above object is a variable directional antenna with a three-element plane configuration, having a feed element and parasitic elements disposed on both sides of the feed element, comprising: each of the parasitic elements disposed on both sides of the feed element including two divided parasitic elements, of which sizes are at a ratio of 1:2 in the lateral direction, wherein the divided parasitic element having the size of 1 is disposed at the side closer to the feed element, and a reactance variable portion is connected to the divided parasitic element having the size of 2.

A variable directional antenna of the first aspect according to the present invention realizing the above object is a variable directional antenna with a three-element plane configuration, having a feed element and parasitic elements disposed on both sides of the feed element, comprising: each of the parasitic elements disposed on both sides of the feed element including two divided parasitic elements, of which sizes are at a ratio of 2:1 in the lateral direction, wherein the divided parasitic element having the size of 2 is disposed at the side closer to the feed element, and a reactance variable portion is connected to one of the divided parasitic elements having the size of 2 and the divided parasitic element having the size of 1.

In the above characteristics, the two divided parasitic elements may be connected to each other with a micro strip line.

Further, the reactance variable portion can be formed on a same surface as that of a substrate, on which the feed element and the parasitic elements disposed on both sides of the feed element are formed, and the reactance variable portion and the parasitic element are connected with a micro strip line formed on the surface of the substrate.

Also, the micro strip line is branched, and the reactance variable portion is connected to the two divided parasitic elements.

Because of the characteristics of the present invention, the side lobe, that generates when the element space is decreased, can be decreased in a variable directional antenna based on the reactance change using the micro strip antenna.

DESCRIPTION OF DRAWINGS

A configuration of an embodiment of the present invention will now be described with reference to the drawings, but in order to assist understanding the configuration and the effect of the variable directional antenna according to the present invention, a comparison example created by the present inventor, similar to the configuration depicted in Non-patent Document 1, will be described first.

Figure 1:
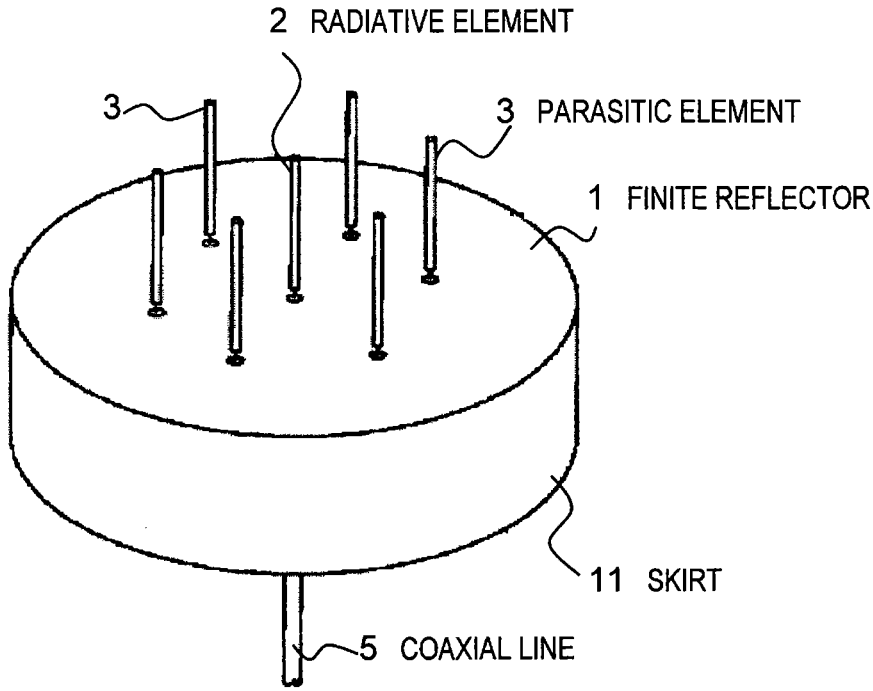
FIG. 1 is a diagram depicting the configuration depicted in Patent Document 1.
Figure 2:
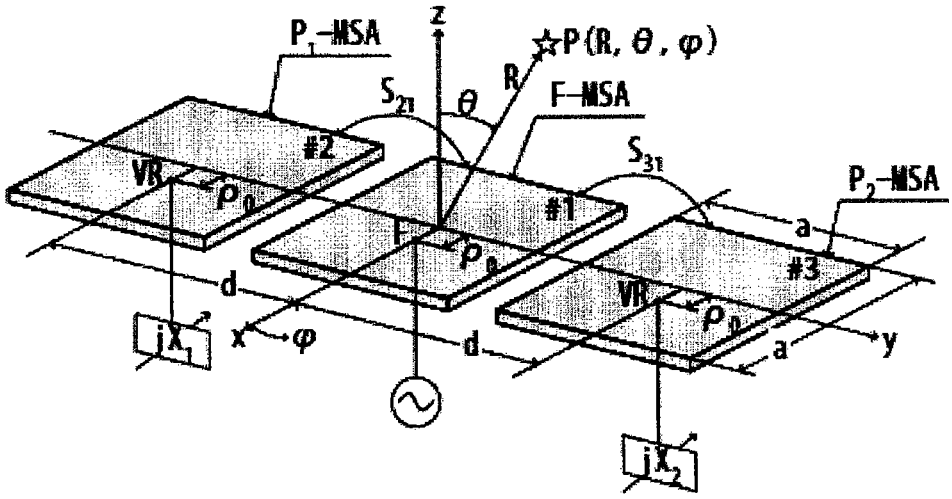
FIG. 2 is a diagram depicting a configuration of a flat type beam shaping antenna using this micro strip antenna.
Figure 3:
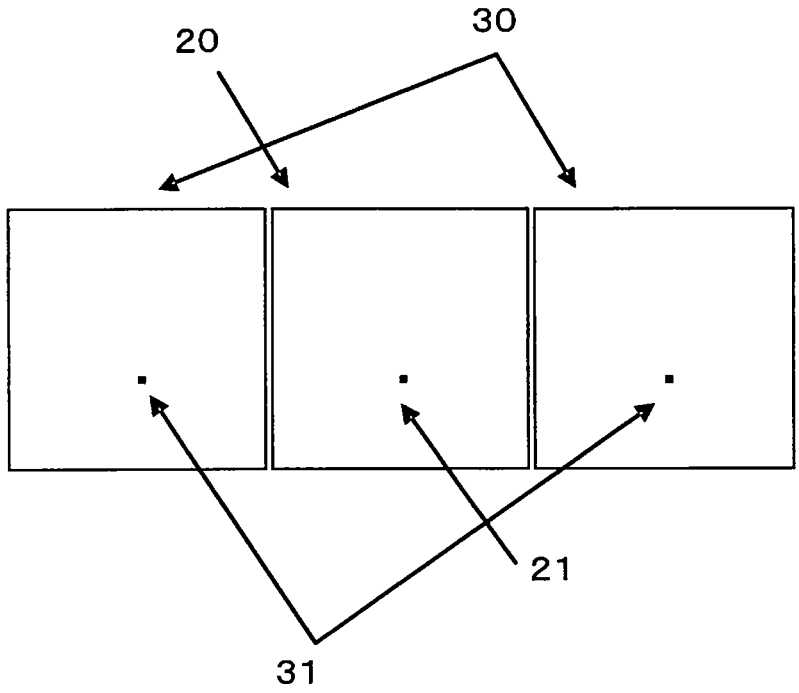
FIG. 3 is a diagram depicting the configuration of a flat type three-element variable directional antenna as a comparison example, and only an antenna pattern of the three elements.
Figure 4:
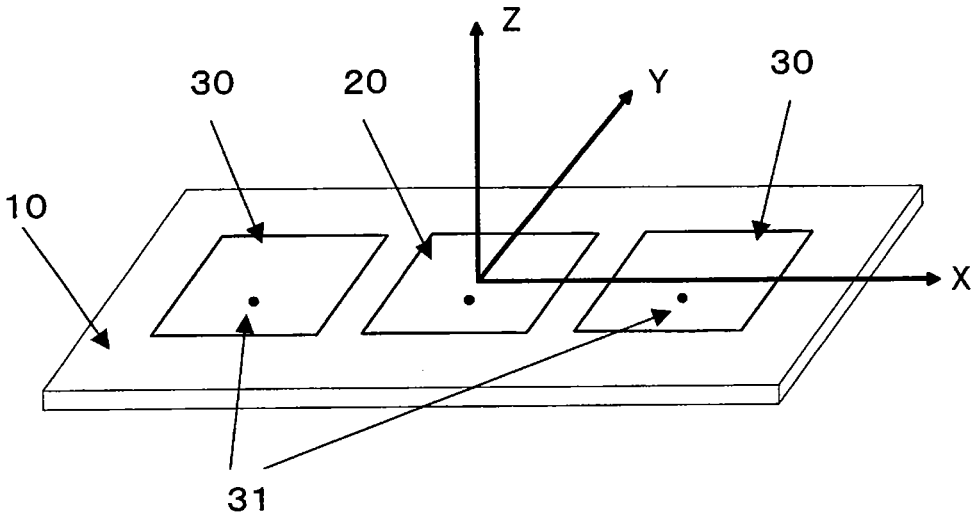
FIG. 4 is a perspective view depicting the configuration of a flat type three-element variable directional antenna as a comparison example.

FIG. 3 and FIG. 4 are diagrams depicting the configuration of a flat type three-element variable directional antenna as a comparison example. In FIG. 3, only an antenna pattern of the three elements is depicted, and FIG. 4 is a perspective view of the variable directional antenna in which the antenna pattern of the three elements is formed on an insulating substrate.

The antenna pattern of the three elements is formed on the insulating substrate 10. The antenna element at the center is a feed element 20, and the antenna elements at the left and right are parasitic elements 30. A feed portion and a reactance variable circuit portion, which are not illustrated, are connected to the port portions 21 and 31 of each antenna element.

In the configuration depicted in FIG. 3 and FIG. 4, the feed portion connected to the port portion 21 is a coaxial feed type. In a reactance variable circuit portion of the parasitic element connected to the port portion 31, a variable capacitance element (e.g. varactor diode, MEMS variable capacitor) is connected to a coaxial line.

The reactance value can be changed in the 0Ω to −100Ω range, for example, using this variable capacitance element, and the directivity of the antenna can be changed by setting the reactance value to an appropriate value.

Here the reactance value of the parasitic element at the left and right are set to 0Ω to −100Ω. The antenna element space of the three elements is 0.4λ according to Non-patent Document 1, but 0.3λ is used here in order to test with a smaller antenna element space.

Figure 5:
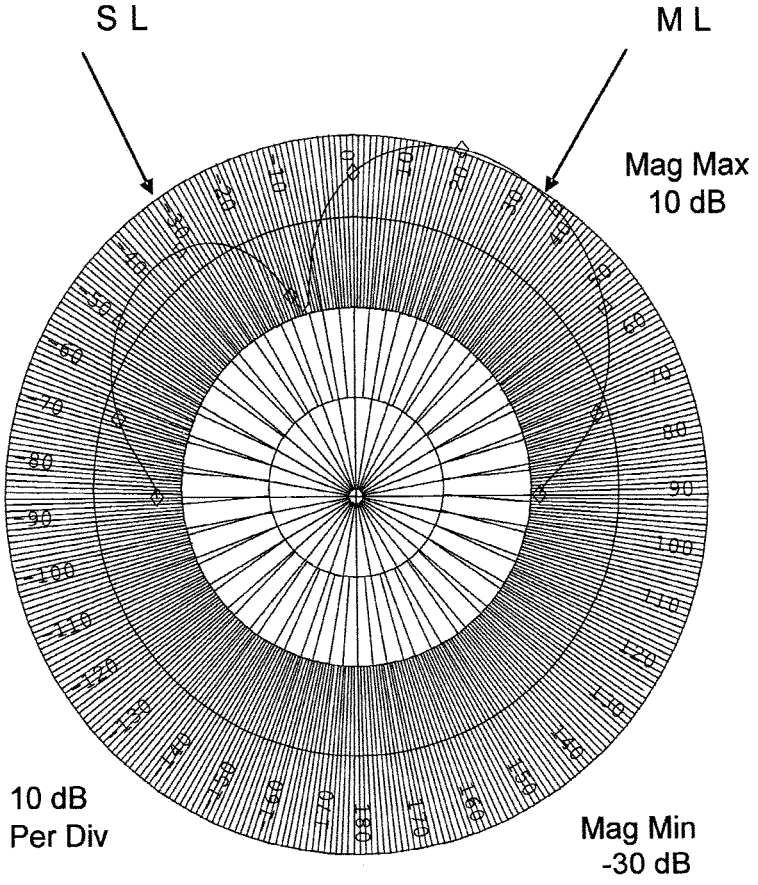
FIG. 5 depicts a directivity pattern of the antenna according to the comparison example of FIG. 4.

FIG. 5 depicts a directivity pattern of the antenna according to this comparison example. The directivity pattern is one plotted on the ZX plane based on the coordinate axes depicted in FIG. 4. The directivity is inclined from the Z direction toward the X axis, which depicts the directivity change. It also depicts that side lobe SL increased as well as the main lobe ML.

Figure 6:
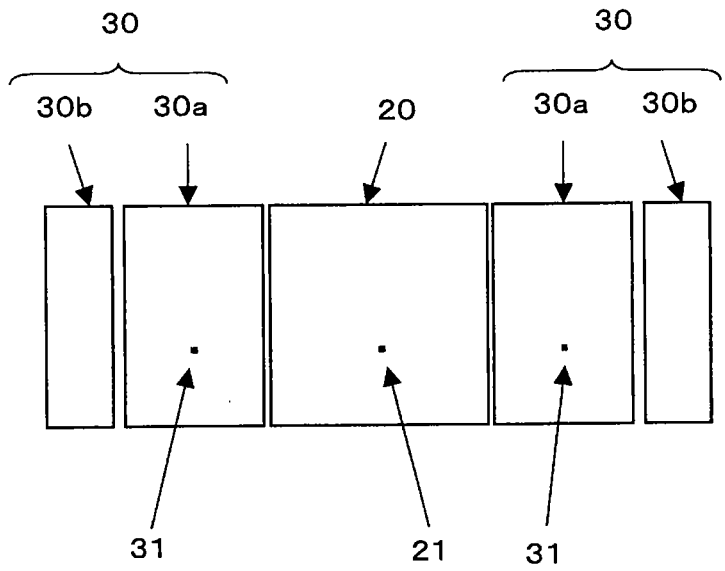
FIG. 6 depicts a configuration of an element pattern of the variable directional antenna according to a first embodiment of the present invention.

While the above is a comparison example, FIG. 6 depicts a configuration of an element pattern of the variable directional antenna according to a first embodiment of the present invention.

As FIG. 6 depicts, in the variable directional antenna of the comparison example depicted in FIG. 3, the respective lateral length of the parasitic elements 30 disposed on both sides of the feed element 20 is divided at 2:1, so as to be two divided parasitic elements 30*a* and 30*b*. In this configuration, the reactance variable portion is connected to a port 31 of the divided parasitic element 30*a*, which is located closer to the feed element 20.

In this configuration, the phase of current, that is supplied to the feed element 20, is adjusted by adjusting the reactance of the reactance variable portion, and current also flows into the parasitic elements 30*b*, thereby an aperture of the antenna can be increased and as a result the side lobe SL can be decreased.

Figure 7:
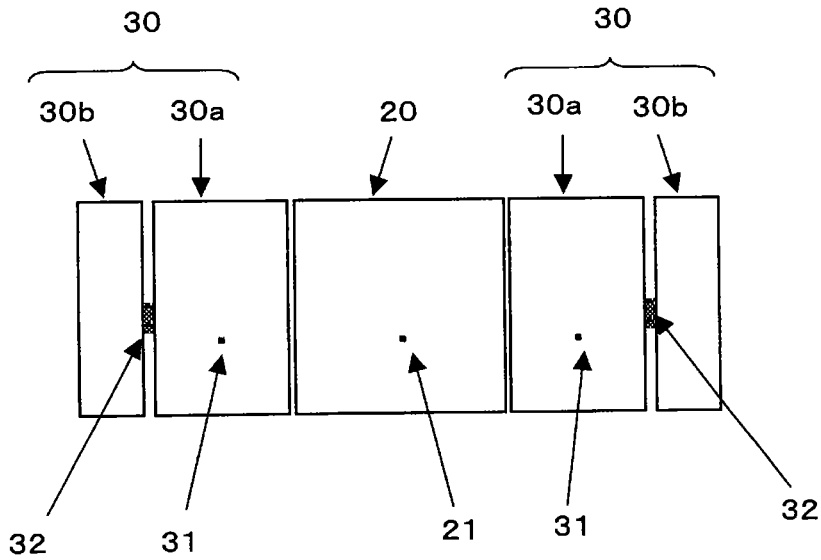
FIG. 7 depicts a configuration of an element pattern of the variable directional antenna according to a second embodiment of the present invention.

FIG. 7 depicts a configuration of an element pattern of the variable directional antenna according to a second embodiment of the present invention.

In the configuration of the second embodiment, a fine micro strip line 32 connects the two parasitic elements 30*a* and 30*b* divided in the first embodiment. The flow of the current in the parasitic element 30*b* can be increased by the micro strip line 32.

Figure 8:
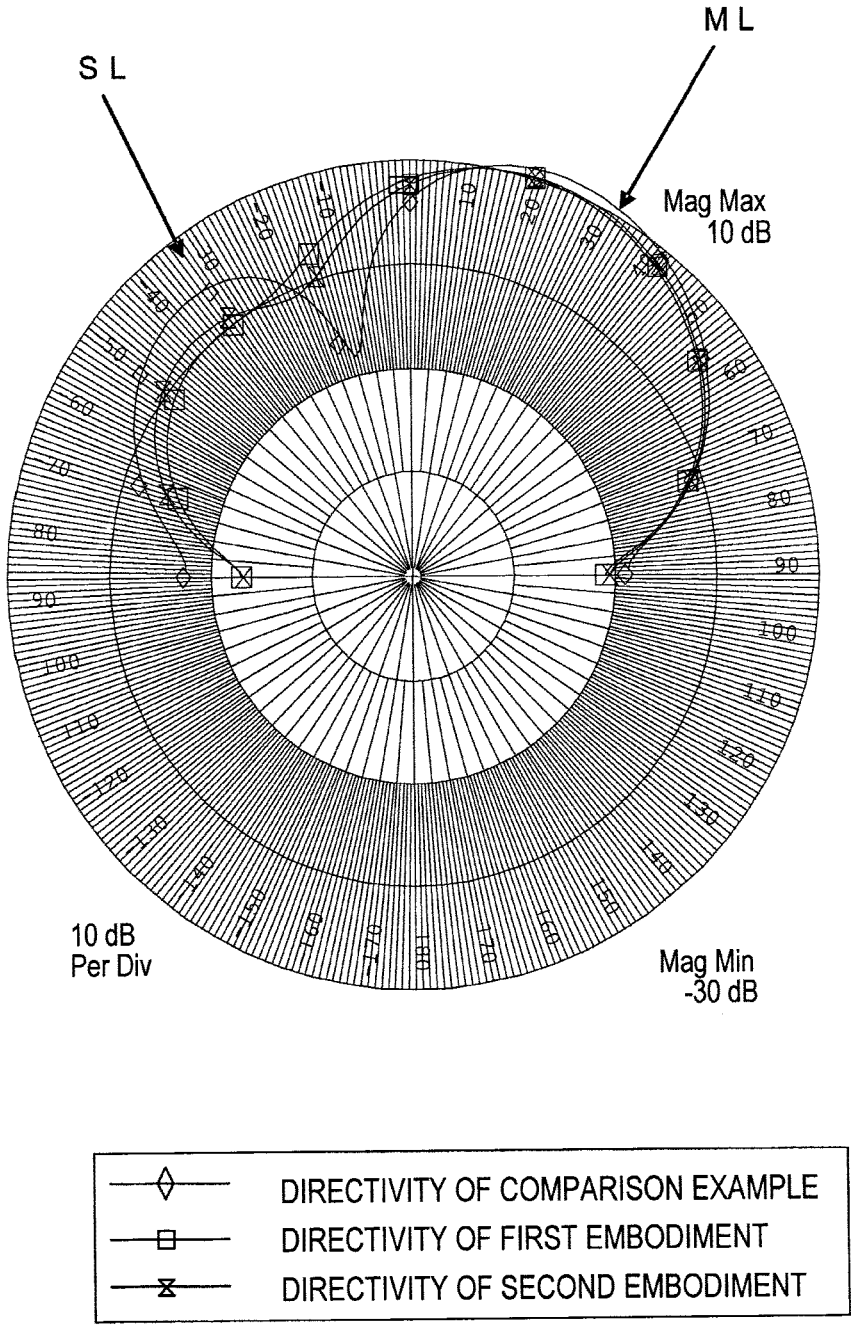
FIG. 8 depicts the directivity patterns of the first embodiment and second embodiment.

FIG. 8 depicts the directivity patterns of the first embodiment and second embodiment. Compared with the directivity pattern of the comparison example, the side lobe SL is decreased in the first embodiment and second embodiment. The frequency used here is 5.06 GHz.

Figure 9:
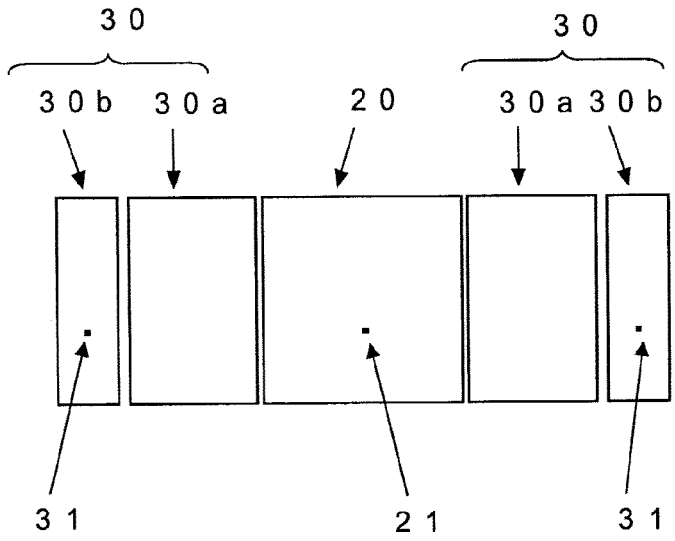
FIG. 9 depicts a configuration of an element pattern of the variable directional antenna according to a third embodiment of the present invention.

FIG. 9 depicts a configuration of an element pattern of the variable directional antenna according to a third embodiment of the present invention.

In the configuration of the third embodiment, a reactance variable portion is connected to a port 31 of the divided parasitic element 30*b*, which is located further away from the feed element 20, of the parasitic elements 30*a* and 30*b*, which are divided at a 2:1 ratio in the lateral length.

Figure 10:
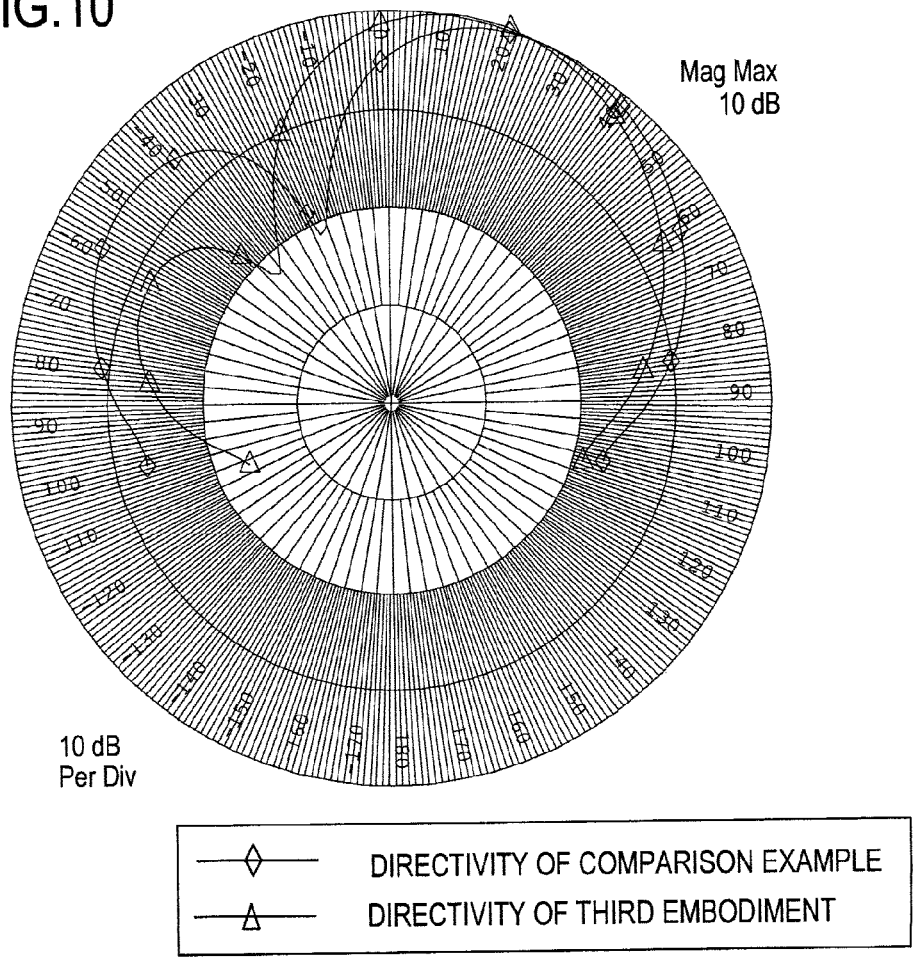
FIG. 10 depicts the directivity pattern of the third embodiment.

FIG. 10 depicts the directivity pattern of the third embodiment. Compared with the comparison example and the first and second embodiments in FIG. 8, the side lobe SL is further decreased.

Figure 11:
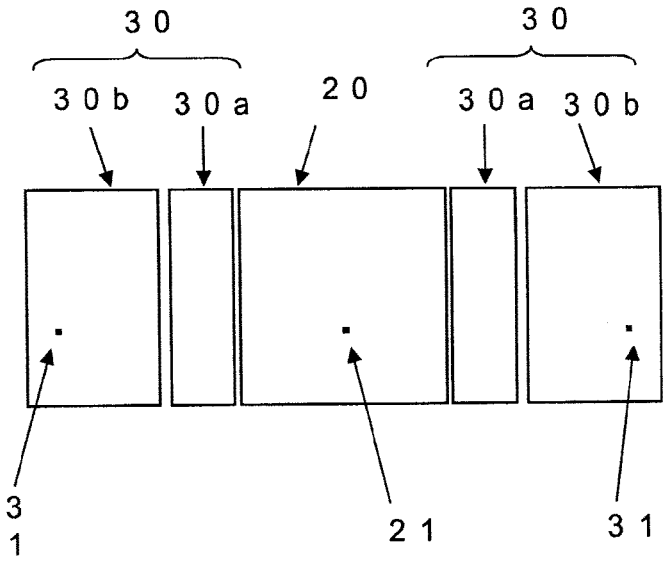
FIG. 11 depicts a configuration of an element pattern of the variable directional antenna according to a fourth embodiment.

FIG. 11 depicts a configuration of a fourth embodiment in which a reactance variable portion is connected to a parasitic element 30*b*, which is located outside, of the parasitic elements 30*a* and 30*b* that are obtained by dividing the parasitic element 30 at a 1:2 ratio in the lateral length.

Figure 12:
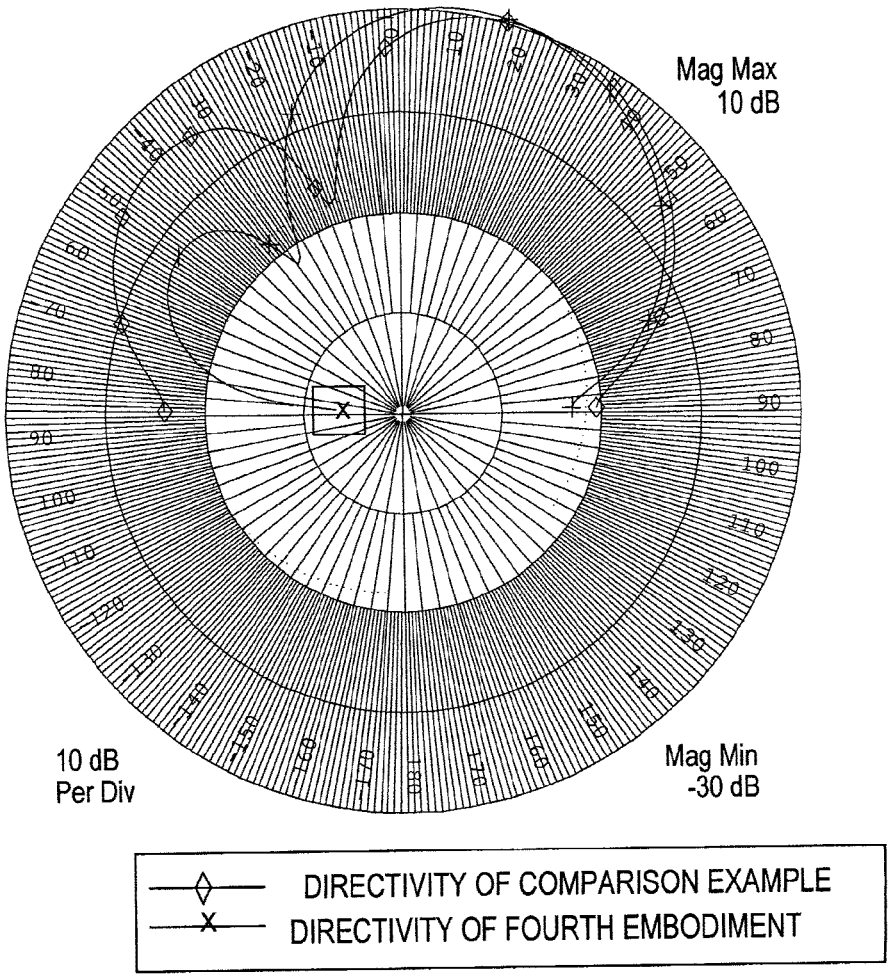
FIG. 12 depicts the directivity pattern of the fourth embodiment.

FIG. 12 depicts the directivity pattern of the fourth embodiment. In this case as well, it is clear that the side lobe SL can be decreased.

According to simulations thus far, as the third and fourth embodiments depict, the side lobe SL can be decreased more if the reactance variable portion is connected to the divided parasitic element 30*b* located outside, that is the side further away from the parasitic element 20, than the divided parasitic element 30*a* located inside, that is the side closer to the parasitic element 20.

Figure 13:
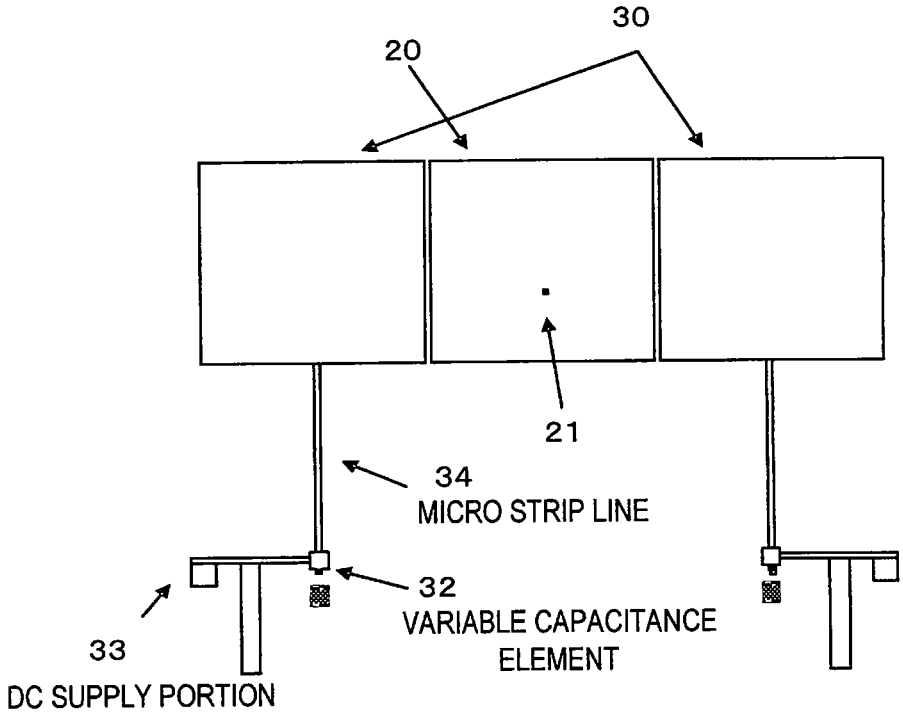
FIG. 13 is a second comparison example when a reactance circuit portion, that is connected to the parasitic element depicted in FIG. 3, is created on a same surface as the substrate where the pattern of a feed element and a parasitic element is formed.

One reason for this is that the divided parasitic element 30*b* outside can more easily secure the required distance between antennas.

Where FIG. 3 is a comparison example pattern of the feed element 20 and parasitic elements 30, FIG. 13 is a second comparison example when a reactance circuit portion, that is connected to the parasitic element 30, is created on a same surface as the substrate where the pattern of the feed element 20 and the parasitic element 30 is formed.

The antenna element portion of the parasitic element 30 and the reactance circuit portion are constituted by a variable capacitance element 32, a DC bias voltage supply portion 33, and a micro strip line 34 with a length of ¼λ.

Just like the coaxial feed type in the previous embodiments, the reactance value changes and directivity of the entire antenna changes by changing the capacity value of the variable capacitance element 32 according to the DC bias voltage of the bias voltage supply portion 33.

Figure 14:
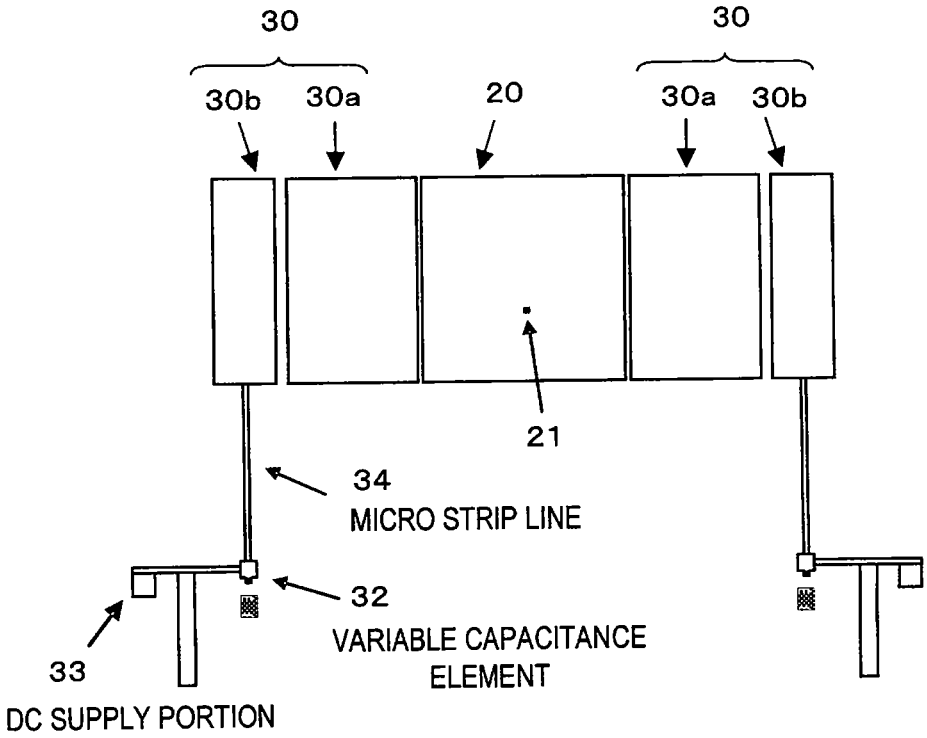
FIG. 14 depicts a configuration of an element pattern of the variable directional antenna according to a fifth embodiment.

While the above is the second comparison example, a fifth embodiment (FIG. 14) and a sixth embodiment (FIG. 15) have a configuration where a pattern of the parasitic element 30 is divided into the divided parasitic elements 30*a* and 30*b*, just like the first embodiment (FIG. 6) and the second embodiment (FIG. 9) respectively.

Figure 16:
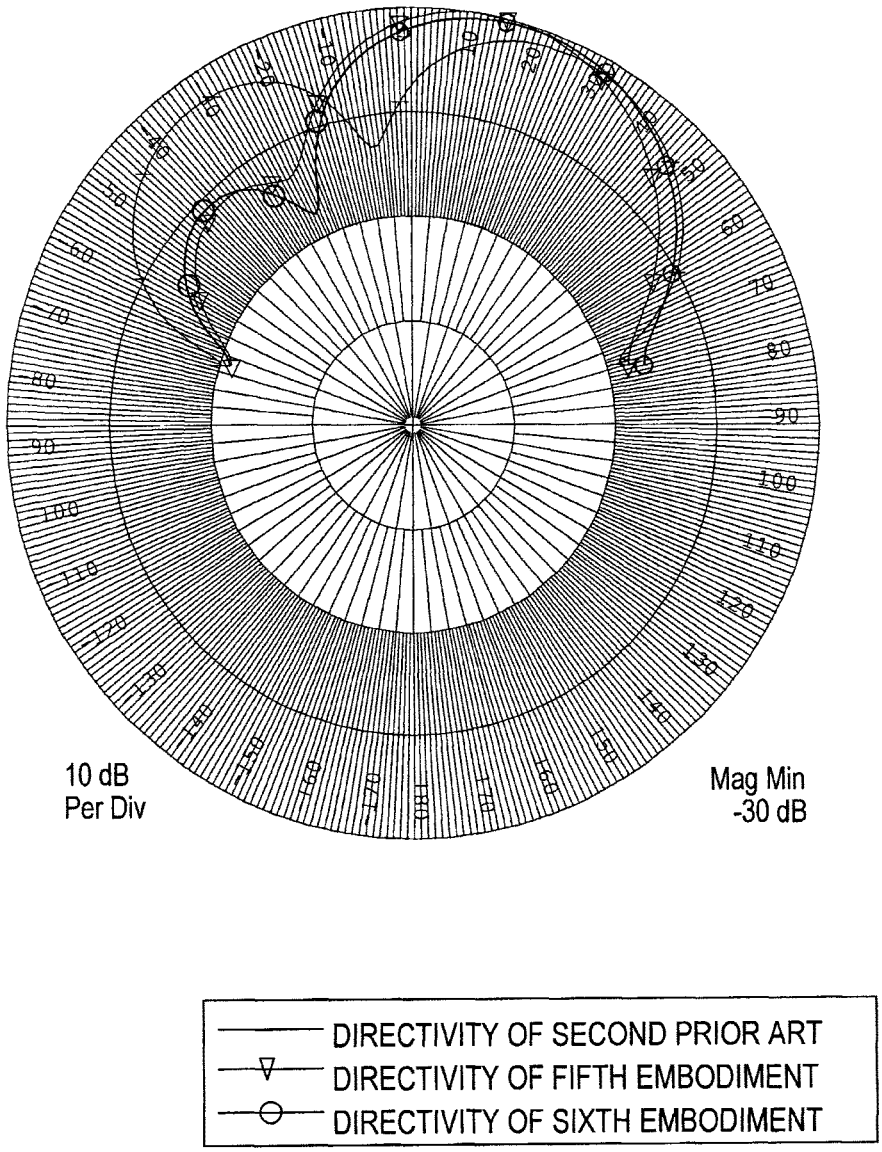
FIG. 16 depicts the directivity patterns of the fifth embodiment and sixth embodiment in comparison with the second comparison example.

FIG. 16 depicts the directivity patterns of the fifth embodiment and sixth embodiment in comparison with the second comparison example. As FIG. 16 depicts, a side lobe can be decreased by also disposing the reactance circuit portion on the surface of the substrate.

Figure 15:
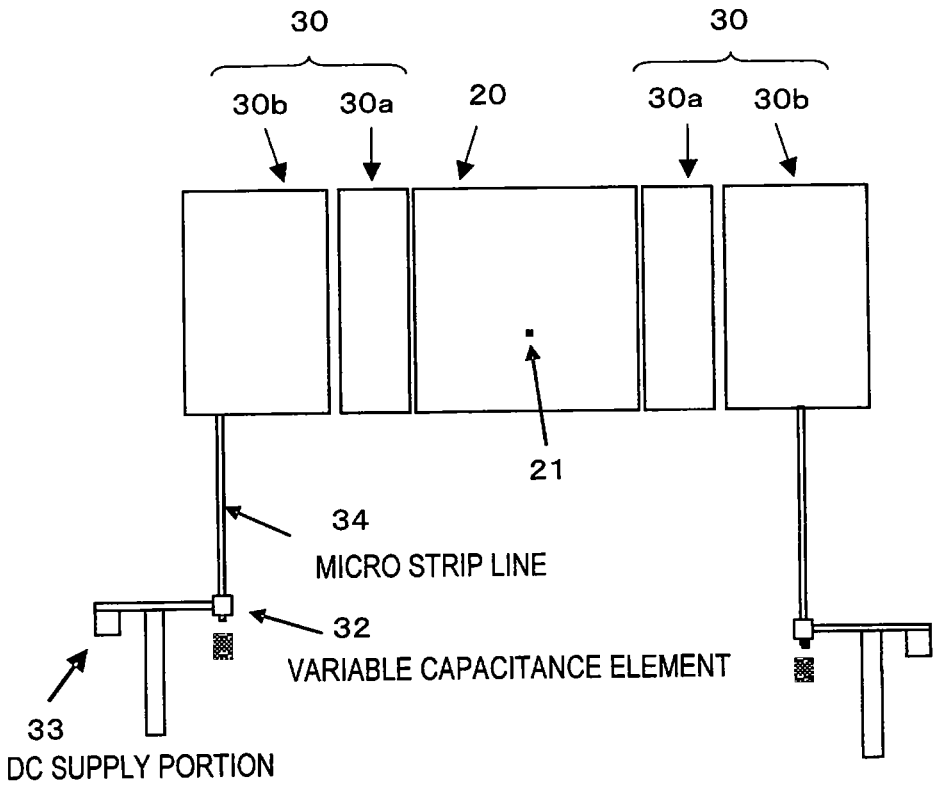
FIG. 15 depicts a configuration of an element pattern of the variable directional antenna according to a sixth embodiment.
Figure 17:
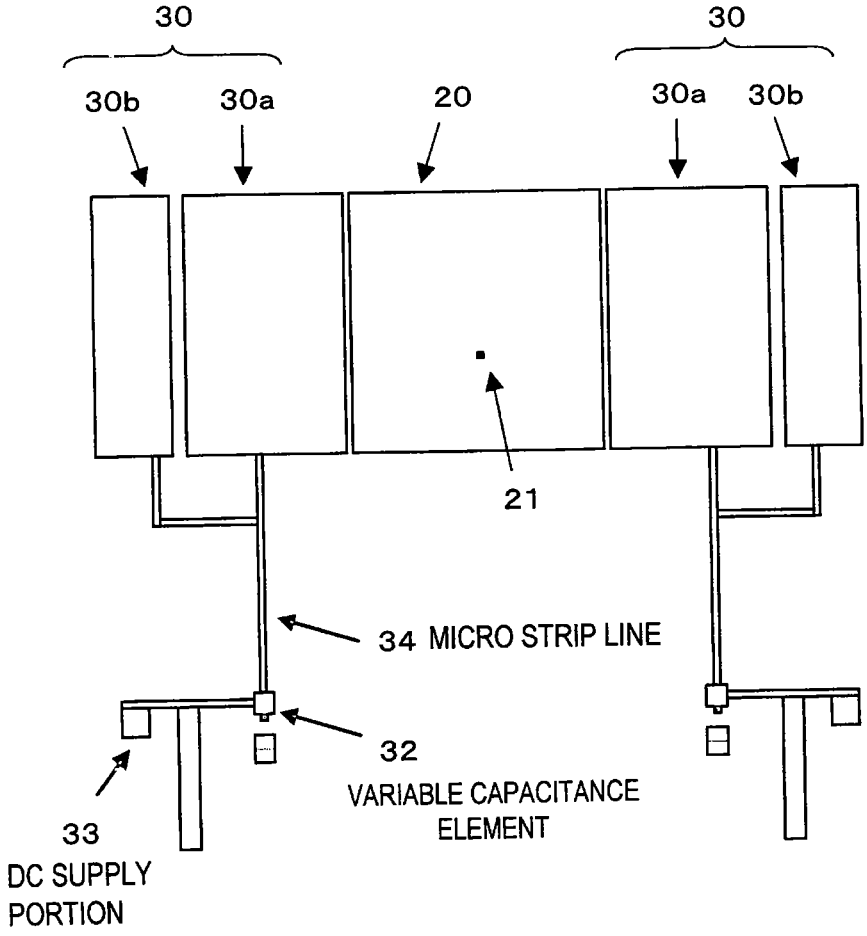
FIG. 17 depicts a configuration of an element pattern of the variable directional antenna according to a seventh embodiment.

FIG. 17 depicts a seventh embodiment, that is a variable directional antenna in which the configuration in FIG. 15 has been improved. In this configuration, the micro strip line 34 is branched and connected to the divided parasitic elements 10*a* and 30*b* in parallel. Thereby the reactance component of the variable capacitance element 32 is supplied, and the divided parasitic element 30*b*, that is the side further away from the parasitic element 20, can be strongly excited. As a result, it can be expected that strong directivity is implemented.

INDUSTRIAL APPLICABILITY

By the above mentioned configuration of the present invention, the element outer side is strongly excited at a different phase, and the aperture plane of the array antenna can be increased while maintaining the coupling between elements. As a result, the side lobe, that is generated when the directivity is controlled, can be decreased. The configuration of the variable directional antenna according to the present invention, which is constructed by dividing the parasitic elements, can be implemented with a size approximately the same as the prior art.

What is claimed is:

1. A variable directional antenna with a three-element plane configuration, comprising:

a feed element; and first and second parasitic elements respectively with the same size as the feed element, disposed on opposite sides of the feed element, wherein each of the first and second parasitic elements disposed on opposite sides of the feed element is divided into two divided parasitic elements, of which sizes are at a ratio of 1:2 in the lateral direction, and wherein one of the two divided parasitic elements has the size of 1, and is disposed closer to the feed element than the other of the two divided parasitic elements, and a reactance variable portion is connected to the other of the two divided parasitic elements, which has the size of 2.

2. A variable directional antenna with a three-element plane configuration, comprising:

a feed element; and first and second parasitic elements respectively with the same size as the feed element, disposed on opposite sides of the feed element; and reactance variable portions connected to the first and second parasitic elements, wherein each of the first and second parasitic elements disposed on opposite sides of the feed element is divided to comprise two divided parasitic element portions, of which sizes are at a ratio of 2:1 in the lateral direction, and wherein one of the two divided parasitic element portions, which has the size of 2 is disposed closer to the feed element than the other of the two divided parasitic element portions, and the reactance variable portions are connected to either one of the two divided parasitic element portions respectively having the size of 2 and the size of 1.

3. The variable directional antenna according to claim 1, wherein the two divided parasitic element portions are connected to each other with a micro strip line.

4. The variable directional antenna according to claim 1, wherein the reactance variable portion is formed on a surface of a same substrate as a substrate on which the feed element and the parasitic elements disposed on opposite sides of the feed element are formed, and the reactance variable portion and the parasitic element are connected with a high frequency line formed on the surface of the substrate.

5. The variable directional antenna according to claim 4, wherein the high frequency line is branched, and the reactance variable portion is connected commonly to the two divided parasitic element portions.

6. The variable directional antenna according to claim 2, wherein the two divided parasitic element portions are connected to each other with a micro strip line.

7. The variable directional antenna according to claim 2, wherein the reactance variable portion is formed on a surface of a same substrate as a substrate on which the feed element and the parasitic elements disposed on both opposite sides of the feed element are formed, and the reactance variable portion and the parasitic element are connected with a high frequency line formed on the surface of the substrate.

8. The variable directional antenna according to claim 7, wherein the high frequency line is branched, and the reactance variable portion is connected commonly to the two divided parasitic element portions.

* * * * *